United States Patent [19]

Walker

[11] 4,018,623

[45] Apr. 19, 1977

[54] METHOD OF CUTTING USING A HIGH PRESSURE WATER JET

[75] Inventor: Michael John Walker, Letchworth, England

[73] Assignee: Imperial Chemical Industries Limited, London, England

[22] Filed: Feb. 10, 1975

[21] Appl. No.: 548,808

[30] Foreign Application Priority Data

Feb. 20, 1974 United Kingdom ..... 7769/74

[52] U.S. Cl. ..... 134/21; 15/302; 15/320; 134/22 R; 134/24; 134/34; 134/38; 239/11

[51] Int. Cl.[2] ..... B08B 3/02

[58] Field of Search ..... 134/21, 22 R, 24, 34, 134/38, 166 R, 167 R; 15/302, 320; 239/11, 225, 227, DIG. 8

[56] References Cited

UNITED STATES PATENTS

| | | | |
|---|---|---|---|
| 2,420,396 | 5/1947 | Heineman | 134/21 X |
| 3,022,792 | 2/1962 | Perkins | 134/21 X |
| 3,384,100 | 5/1968 | Ross et al. | 134/166 R |
| 3,479,679 | 11/1969 | Vogel | 134/166 R X |
| 3,594,849 | 7/1971 | Coshow | 134/21 X |
| 3,619,295 | 11/1971 | Nishizaki et al. | 134/22 R |
| 3,705,437 | 12/1972 | Rukavina et al. | 15/302 |
| 3,719,191 | 3/1973 | Zimmerly | 134/21 X |
| 3,753,777 | 8/1973 | Thomsen et al. | 134/21 X |

*Primary Examiner*—Robert L. Lindsay, Jr.
*Assistant Examiner*—Marc L. Caroff
*Attorney, Agent, or Firm*—Cushman, Darby & Cushman

[57] ABSTRACT

A method of cutting using a high pressure jet of water in which the jet is maintained in a region of sub-atmospheric pressure, preferably up to 70 cms Hg. Operation at sub-atmospheric pressure significantly enhances the cutting power of a high pressure water jet.

7 Claims, 2 Drawing Figures

METHOD OF CUTTING USING A HIGH PRESSURE WATER JET

Figure 1:
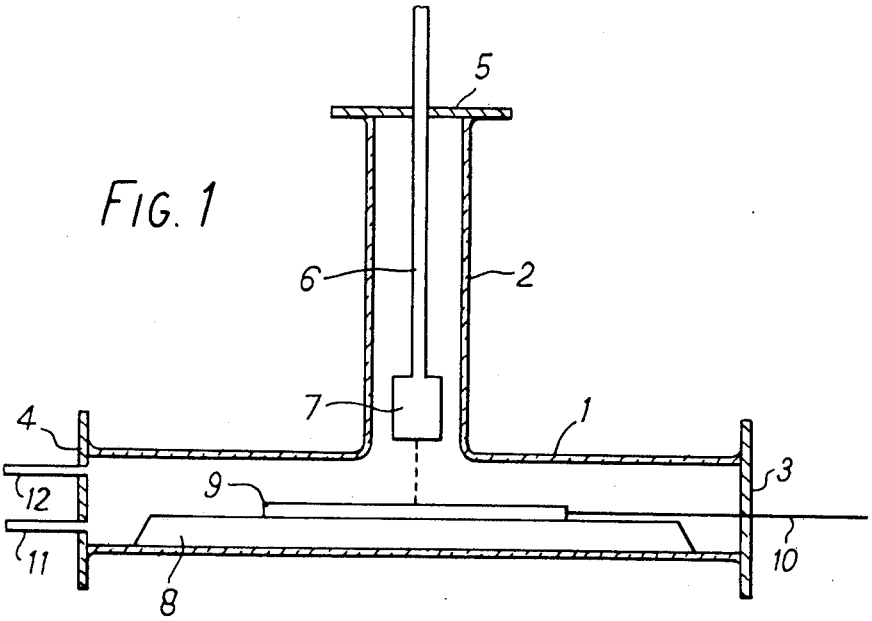

The present invention relates to a method of cutting using a high pressure jet of water.

It is known to use a jet of water delivered from a nozzle under very high pressures for cutting purposes, e.g. slicing, or shaping materials such as paper, cardboard, wood and stone, and for cleaning operations in which the cutting action of the water jet removes or loosens material adhering to a surface to be cleaned. An important example of the use of high pressure water-jets is in the cleaning of polymerisation reactors where the high pressure water-jets are used to remove or loosen polymer deposits sticking tenaciously to the wall of the reactor. This type of operation is known as hydrodynamic cleaning and is extensively used, for example, in the cleaning of autoclaves used for making vinyl chloride polymers.

The velocity with which a jet of water leaves the nozzle will increase with the applied hydraulic pressure and the delivery at high pressure of very high velocity water onto a small area of material will produce extremely high local forces which can cause shearing and fracture of the material. The flow rate of the water through a nozzle can be varied independently of the applied pressure according to the diameter of the nozzle orifice.

For slicing and shaping types of operation, very high water pressures are generally used (e.g. more than 1000 atmospheres) in conjunction with relatively low water flow rates. For cleaning operations, lower pressures are used (e.g. 100 – 500 atmospheres) in conjunction with high water flow rates. In the case of an operation to remove polymer deposits adhering to the wall of a reactor, a typical operating pressure is about 200 atmospheres with a water flow rate of between 100 – 280 litres per minute. Under such conditions, velocities of typical emerging jets are about 200 – 400 m per second.

According to the present invention there is provided a method of cutting using a high pressure jet of water in which the jet is maintained in a region of sub-atmospheric pressure.

Hitherto, high pressure jets of water have been exposed to the ambient atmospheric pressure during the cutting operation. It has now been discovered that if the emergent high pressure jet is maintained in a region of sub-atmospheric pressure, the cutting power of the jet is significantly enhanced.

It is found that while a slight lowering of the pressure below the ambient atmospheric pressure will marginally improve cutting power, the best results are achieved when the pressure is well below atmospheric. Conveniently, the upper limit of the pressure of the medium surrounding the water-jet in our invention is 70 cms Hg, provided, as will be likely, this pressure is below the ambient atmospheric pressure. The cutting power of a water-jet having a given applied hydraulic pressure will increase as the pressure of the surrounding medium decreases, i.e. the lower the pressure of the surrounding medium the greater the cutting power of the jet.

It is to be understood that the method of the invention is intended to embrace operations such as the cleaning of the inside wall of a polymerisation reactor having polymeric build-up adhered thereto whereby the high pressure jet may exert an abrasive action rather than a slicing or shaping action.

Accordingly there is provided in a preferred embodiment of the invention a method of cutting using a high pressure jet of water wherein the jet is delivered inside a closed polymerisation reactor maintained under sub-atmospheric pressure whereby the cutting action of the jet acts to remove or loosen material adhering to the inside wall of the reactor.

In order for a water-jet to be maintained in a region of sub-atmospheric pressure, it is clear that the region around the jet should be capable of complete enclosure in order to be able to effect the evacuation thereof. This is normally the situation, for example, in many types of polymerisation reactor which in any case often need to be pressure tight for the purposes of the polymerisation reaction and are also often equipped with or linked with vacuum pumps for evacuating the inside of the reactor so as to remove oxygen which might inhibit the polymerisation reaction. Typical reactors of this type are autoclaves used for producing vinyl chloride polymers. When operating hydrodynamic cleaning according to the invention in such reactors, it is desirable to pump the spent cleaning water out of the reactor to ensure that the jets do not become impeded by an accumulation of the spent water.

It is to be understood that the low pressure atmosphere surrounding the jet need not necessarily consist of air, although this will be the usual situation. It may, for example, consist of another gas such as nitrogen at a pressure below that of atmospheric.

The cutting power of a high pressure jet of water will of course also be dependent on the actual applied hydraulic pressure of the jet; the greater the hydraulic pressure, the greater the cutting power. The hydraulic pressure should not of course be so great as to cause the jet to atomise as soon as it leaves the nozzle so that no coherent jet at all is formed. The method of our invention may be applied to a high pressure water jet of any given hydraulic pressure (with the above proviso) and it will improve the cutting power of that water-jet. However, in order to achieve the most significant improvements, the hydraulic pressure of the jet should preferably be at least 70 atmospheres (1000 psi absolute).

When a high pressure jet of water is exposed to atmospheric pressure it rapidly diverges from the nozzle exit which leads to loss of kinetic energy. Consequently, it has been the practice hitherto to place the nozzle as close to the surface being worked on as possible in order to minimise divergence of the water-jet and hence maximum cutting power. However in many cases, it is not convenient or practicable for the nozzle to be close to the work. For example, design features of the particular equipment in question may prevent the nozzle from reaching into certain restricted places.

Operation of a high pressure water-jet according to the invention reduces divergence of the jet; the lower the pressure of the surrounding medium, the lower the divergence of the jet. In fact, at very low pressures, e.g. below 10 cms of Hg, there is virtually no divergence at all of the water-jet and the nozzle may be placed at quite long distances from the work without incurring significant loss of energy and hence cutting power. This is most useful in the cleaning of polymerisation reactors when employing commercially available units which comprise a plurality of nozzles on a rotatable central head for delivering high pressure jets of water at variable angles; the head can be conveniently positioned and the jets will be able to reach any point in the evacuated area without significant loss of cutting power.

It is known that certain water-soluble linear polymers of very high molecular weight exhibit drag-reducing properties when used at very high dilution to water. It is found that the use of such solutions as high pressure water jets also enhances the cutting power of the jets and may be employed in the method of the invention to add further to the cutting power of a jet achieved by reducing the surrounding pressure. Examples of such polymers include linear polyacrylamide and polyethylene oxide. The latter material is commerically available under the trade name "Polyox." For example, "Polyox" WSR 301 has a molecular weight of $4 \times 10^6$ and remains effective at concentrations even less than 10 ppm in water. The use of too much solute should be avoided as this will decrease the cutting power of the jet presumably because of the high viscosity of the solution. For "Polyox" WSR 301, up to 200 ppm has been found to be useful with maximum cutting power being achieved at about 100 ppm.

Figure 2:
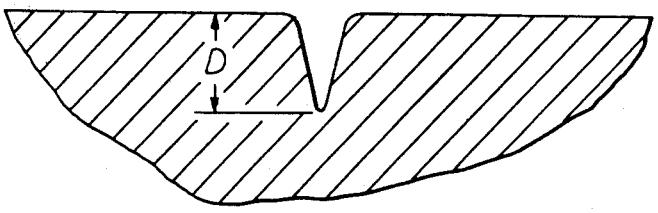

The present invention is illustrated by reference to the accompanying drawings in which FIG. 1 is a diagrammatic representation of an apparatus for demonstrating the utility of the present invention;

FIG. 2 shows in cross-section a cut made on a sample using the apparatus of FIG. 1.

The apparatus of FIG. 1 comprises a horizontal glass tube 1 joined to a vertical glass tube 2, the ends of 1 having Quick-fit seals 3, 4 and the end of 2 having a Quick-fit seal 5. A pipe 6, with a nozzle 7 attached thereto, is adjustably located in tube 2 the end of the pipe 6 extending through the seal 5. Tube 1 contains a platform 8 on which a sample 9 can be placed, the sample being movable in front of the nozzle by a pull wire 10 extending through the seal 3, using winding means (not shown). The apparatus is evacuatable by means of a water vacuum pump (not shown) in connection with a conduit 11. A conduit 12 is connected to a pressure gauge (not shown).

Means (not shown) are provided to deliver water at pressures of up to 300 atmospheres, through the pipe 6 and nozzle 7, onto the sample 9 which may be made of any material suitable for demonstration purposes, e.g. plaster of Paris.

The line of the water jet from the nozzle to the sample is represented by the dotted line. The distance of the nozzle from the sample may be varied on account of the adjustable location of the pipe 6 in the tube 2. The water is carried away through conduit 11, the vacuum pump being provided with a trap.

FIG. 2 shows in cross-section the shape of a typical water-jet cut that has been made by pulling a sample made of plaster of Paris in front of the nozzle. The depth of the cut is termed D.

EXAMPLES 1 to 20

A series of experiments was carried out using apparatus of FIG. 1. The apparatus was used as described above, the samples being pulled across the nozzle at a rate of 0.5 cms per second in each example and being made of plaster of Paris. The nozzle diameter in each example was 0.2 mm.

For a given distance of the nozzle from the sample, three different hydraulic pressures were employed, viz. 1000 psi (about 70 atmospheres), 2000 psi (about 140 atmospheres) and 3000 psi (about 210 atmospheres). For each value of hydraulic pressure samples were drawn across the nozzle with the air pressure inside the apparatus being atmospheric (76 cms Hg), 66 cms Hg, 26 cms Hg, and 6 cms Hg respectively. The nozzle to sample distances used were 5 cms, 15 cms, 20 cms and 23 cms. In each experiment the depth of the cut D was measured by sectioning the sample concerned. The results are shown in the following table.

| Example No. | Nozzle to sample Distance (cms) | Pressure inside Apparatus (cm Hg absolute) | Depth of cut D (mms) at hydraulic pressure of 1000 psi | 2000 psi | 3000 psi |
|---|---|---|---|---|---|
| 1 | | 76 | 2.7 | 6.6 | 9.6 |
| 2 | | 66 | 2.8 | 8.2 | 10.2 |
| 3 | 5 | 46 | 3.7 | 10.5 | 12.8 |
| 4 | | 26 | 3.4 | 11.3 | 13.0 |
| 5 | | 6 | 3.6 | 14.6 | 16.5 |
| 6 | | 76 | 0.6 | 3.3 | 10.1 |
| 7 | | 66 | 1.4 | 3.8 | 11.0 |
| 8 | 15 | 46 | 2.2 | 7.2 | 12.9 |
| 9 | | 26 | 2.4 | 11.2 | 17.4 |
| 10 | | 6 | 2.8 | 9.8 | 16.3 |
| 11 | | 76 | 0.7 | 2.9 | 4.6 |
| 12 | | 66 | 1.4 | 4.2 | 6.1 |
| 13 | 20 | 46 | 2.2 | 4.2 | 8.3 |
| 14 | | 26 | 2.5 | 8.9 | 10.2 |
| 15 | | 6 | 2.8 | 9.1 | 13.0 |
| 16 | | 76 | 0.7 | 2.6 | 4.2 |
| 17 | | 66 | 1.3 | 3.1 | 4.7 |
| 18 | 23 | 46 | 2.7 | 5.6 | 6.6 |
| 19 | | 26 | 3.2 | 7.6 | 9.9 |
| 20 | | 6 | 3.2 | 10.2 | 14.8 |

It can be seen from the table that the depth of cut for a given hydraulic pressure increased as the air pressure inside the apparatus was reduced. At a pressure of 6 cms Hg inside the apparatus, the depth of cut was fairly independent of the nozzle to sample distance, indicating little loss of energy with increase of nozzle-sample distance. With increasing air pressure, the depth of cut became more dependent on the distance between the nozzle and the sample, although an improvement in cutting power was obtained at all pressures below atmospheric.

EXAMPLES 21 and 22

In these Examples the method of the invention was applied to the cleaning of cylindrical stainless steel reactors used for the production on a commercial scale, of granular vinyl chloride polymers. Vinyl chloride polymerisations invariably produce a layer of polymeric build-up on the inside wall of a reactor which (after discharging the rector contents) must be removed before the reactor is used for another polymerisation. A commercially available hydrodynamic cleaning probe comprising four nozzles on a rotatable central boss (in standard use for cleaning reactors employed for vinyl chloride polymerisations) was used for the experiments, the high pressure hose leading from the probe and probe suspension wires passing through pressure tight seals in the reactor lid which had been specially adapted for the experiments. In this way the probe could be operated to effect hydrodynamic cleaning with the interior of the reactor maintained under vacuum.

With the lid in position on the reactor, it was possible to achieve pressures down to 0.1 atmosphere while the probe was running using the same evacuation system normally employed for purging oxygen before the start of polymerisation. It was possible to tell that the head was turning inside the autoclave by listening against a piece of pipework, when the water jets could be heard impingeing on the walls as they went round.

In Example 21 an emptied reactor with a layer of build-up was cleaned according to the invention using the equipment described above, the pressure of the water delivered being about 3100 psi, the pressure inside the reactor being 0.1 – 0.3 atmosphere and the period of cleaning being 1 hour. The probe was moved into 5 standard positions (spaced along the cylindrical reactor from bottom to top) during the cleaning as in conventional cleaning with this probe. It was found that remarkably effective cleaning had been achieved as compared to conventional cleaning using the same equipment and conditions (but with the reactor interior at atmospheric pressure) which had resulted in very little removal of the build-up.

In Example 22 the method of the invention was used to clean a reactor which had already been subjected to a conventional clean with the equipment (but which still had a layer of build-up) to see if any additional improvement could be achieved. The conditions were substantially the same as in Example 21 (water pressure about 3000 psi, pressure inside reactor 0.2 – 0.4 atmosphere, time of cleaning 1 hour). A marked improvement in the cleanliness of the reactor wall was achieved.

I claim:

1. A method of cleaning the interior of a polymerisation reactor having polymeric build-up adhering to the inside wall thereof which method comprises delivering a jet of water with hydraulic pressure of at least 70 atmospheres ($68.6 \times 10^5$ N/$m_2$) inside the reactor onto said build-up while maintaining the entire interior of the reactor at sub-atmospheric pressure whereby the jet exerts a cutting action to remove or loosen said polymeric build-up.

2. A method according to claim 1 wherein the interior of the reactor is maintained at a pressure of up to 70 cm Hg ($9.2 \times 10^4$ N/$m^2$).

3. A method according to claim 1 wherein the hydraulic pressure of the jet employed is 100–500 atmospheres ($9.8 \times 10^6 - 49.6 \times 10^6$ N/$m^2$).

4. A method according to claim 1 wherein the water jet employed is a dilute aqueous solution of a drag-reducing high molecular weight linear polymer.

5. A method according to claim 4 wherein the polymer employed is polyacrylamide or polyethylene oxide.

6. A method according to claim 1 wherein the interior of the reactor is maintained at a pressure not exceeding about 10 cm Hg.

7. A method of cleaning the interior of a polymerization reactor vessel having polymeric build-up adhering to the inside surface of the vessel, said method comprising introducing a jet-forming nozzle into the vessel, delivering water at a pressure of at least 70 atmospheres to the nozzle to thereby form a high-pressure water jet, passing the jet through the atmosphere within the vessel and impinging the jet onto the polymeric build-up to thereby remove or loosen the build-up, evacuating the entire vessel to sub-atmospheric pressure of up to 70 cm Hg while the jet impinges on the polymeric build-up to thereby reduce divergence of the jet and increase its ability to cut the build-up, and removing spent water and removed build-up from the vessel.

* * * * *